United States Patent [19]

Regalbuto

[11] Patent Number: 4,534,423

[45] Date of Patent: Aug. 13, 1985

[54] PERFORATING GUN CARRIER AND METHOD OF MAKING

[75] Inventor: John A. Regalbuto, Forth Worth, Tex.

[73] Assignee: Jet Research Center, Inc., Arlington, Tex.

[21] Appl. No.: 491,624

[22] Filed: May 5, 1983

[51] Int. Cl.[3] ..... E21B 43/11

[52] U.S. Cl. ..... 175/4.6; 166/55; 166/297

[58] Field of Search ..... 175/4.6, 4.51, 4.52, 175/4.53, 4.54, 4.55, 4.56, 4.57, 4.58, 4.59; 166/297, 55; 102/306, 307, 308, 309, 310

[56] References Cited

U.S. PATENT DOCUMENTS

| | | | |
|---|---|---|---|
| 2,649,046 | 8/1953 | Davis | 175/4.6 X |
| 2,750,885 | 6/1956 | Schlumberger | 175/4.6 |
| 3,029,732 | 4/1962 | Greene | 102/310 |
| 3,121,465 | 2/1964 | Stephens | 166/164 |
| 3,128,702 | 4/1964 | Christopher | 175/4.6 |
| 3,380,551 | 4/1968 | Lang | 181/103 |
| 3,429,384 | 2/1969 | Shore | 175/4.6 |
| 3,589,453 | 6/1971 | Venghiattis | 175/4.6 |
| 3,773,119 | 11/1973 | Shore | 175/4.6 |
| 3,856,094 | 12/1974 | Davis | 175/4.52 |
| 4,428,440 | 1/1984 | McPhee | 175/4.6 |

FOREIGN PATENT DOCUMENTS

| | | | |
|---|---|---|---|
| 248592 | 1/1970 | U.S.S.R. | 175/4.53 |

*Primary Examiner*—Stephen J. Novosad
*Assistant Examiner*—William P. Neuder
*Attorney, Agent, or Firm*—Joseph A. Walkowski; Thomas R. Weaver

[57] ABSTRACT

A perforating gun carrier comprising an inner substantially tubular housing within an outer substantially tubular sleeve. The inner housing includes gun ports extending through the wall thereof in a pattern corresponding to the pattern of shaped charges to be carried within. The sleeve may be secured to the housing by welding, soldering, brazing, adhesive bonding or other known method, may be shrink-fit onto the housing, or may be mechanically secured thereon.

19 Claims, 8 Drawing Figures

PERFORATING GUN CARRIER AND METHOD OF MAKING

BACKGROUND OF THE INVENTION

The present invention relates generally to well perforating, such as is practiced in the petroleum industry, and specifically to carriers for perforating guns holding shaped charges utilized in perforating well bore casing and producing formations.

Shaped charges are employed to perforate casing and surrounding producing formations due to their ability to produce long, tunnel-like perforations in a producing formation without the use of a projectile and without injecting a great deal of debris and residue into the perforations. However, the penetration characteristics of a shaped charge jet are greatly dependent upon the stand-off of the shaped charge, which may be defined as the distance between the base of the liner cone in a shaped charge and the nearest significant obstruction in front of the charge, which may be a cover over the mouth of the charge, the inner wall of a perforating gun carrier, or the inner portion of a plug in a gun port of a carrier, all of which are well known and widely employed in the art. In recent years, the petroleum industry trend has been toward the use of "high density" perforating, which involves the clustering of multiple shaped charges and the stacking of these clusters in the perforating gun carrier to effect 12 or more perforations per foot of interval of producing formation. Charge clusters are usually rotated with respect to the adjacent ones above and below them, to provide rotationally offset perforations which have a reduced tendency to weaken casing and are thought to provide better overall fluid flow from the producing formation. However, clustering of charges brings about a very significant decrease in the stand-off for each shaped charge in the cluster, which in turn decreases penetration of the formation and reduces to a significant degree the advantages of the clustered charges and large number of resulting perforations.

The problems associated with reduction of stand-off have been recognized in U.S. Pat. No. 3,429,384, issued to J. B. Shore on Feb. 25, 1969, the disclosure of which deals with the reduction of stand-off associated with the use of a very large shaped charge in a tubular carrier, and indicates that even a fraction of an inch increase in stand-off can result in as much as a twenty percent increase in penetration depth. The patent to Shore discloses the use of a tubular perforating gun carrier having concave depressions machined in the exterior thereof, the centers of which are subsequently dimpled outward with a forming tool placed in the interior of the carrier. The resulting configuration provides an increase in stand-off equal to the depth of the dimple, while the machined depression and resulting thinning of the carrier wall reduces the outward protrusion and thickness of the burr which is formed by the shaped charge adjacent the dimple when it is fired. These latter phenomena make the carrier less likely to stick in the tubing string as it is retrieved. However, the configuration and method of effecting same as disclosed in the patent to Shore possess a number of inherent disadvantages. First, the method of achieving the concavity with dimple therein involves precision machining of the depressions to a predetermined depth and subsequent use of a forming tool, which must be precisely oriented. Second, the reduction of the wall thickness is not practical for carriers having clusters of three, four or even five shaped charges at a single level, due to the unacceptable decrease in compressive strength in the carrier wall, and the possibility of total destruction of the carrier upon firing of the charges, with attendant clogging of the well bore with debris. Furthermore, precise alignment of the shaped charges within the carrier with each dimple is required for maximum effectiveness.

SUMMARY OF THE INVENTION

In contrast to the prior art, the present invention provides relatively simple, inexpensive perforating gun carrier and methods of making such a carrier possessing greatly increased stand-off for multiple shaped charge clusters, great compressive strength, and reduction of burring around the gun ports. The perforating gun carrier of the present invention comprises an inner substantially tubular housing within an outer substantially tubular sleeve. The inner housing includes gun ports extending through the wall thereof in a pattern corresponding to the pattern of shaped charges to be carried within. The sleeve may be secured to the housing in any one of a number of ways, including but not limited to, welding, soldering, brazing or adhesive bonding. Alternatively, the sleeve may be shrink-fit to the housing, or merely slipped over the housing and held in place at either end by mechanical means.

BRIEF DESCRIPTION OF THE DRAWINGS

The method and apparatus of the present invention will be more readily understood by one of ordinary skill in the art by reference to the following detailed description, taken in conjunction with the accompanying drawings, wherein.

DETAILED DESCRIPTION OF THE FIRST PREFERRED EMBODIMENT

Figure 1:
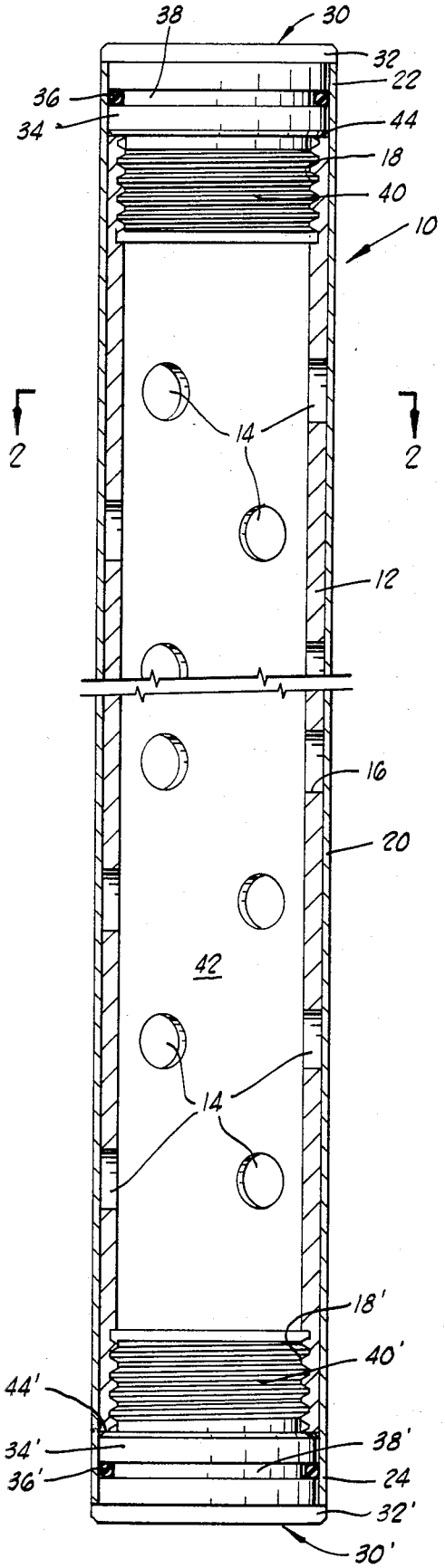
FIG. 1 is a vertical full section elevation of a first preferred embodiment of the perforating gun carrier of the present invention.
Figure 2:
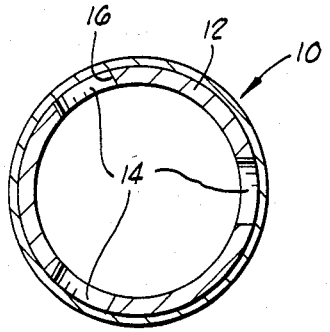
FIG. 2 is a section taken across FIG. 1 at arrows 2—2.

Referring to FIGS. 1 and 2, the first preferred embodiment 10 of the perforating gun carrier of the present invention is shown vertically as it would be disposed in a well bore. So as not to detract from the clarity of the illustration of the present invention, carrier 10 has been shown capped at both ends with bull plugs rather than with tandem connectors, firing head connectors or other hardware employed to connect carriers and/or initiate the shaped charges within, such apparatus being well known in the art, and not germaine to an understanding of the present invention.

Carrier 10 comprises substantially tubular inner housing 12, having a plurality of cylindrical gun ports 14 defined by laterally oriented walls 16 extending through the wall thereof, gun ports 14 being disposed in a pattern corresponding to that of the shaped charges carried within. Gun ports 14 in carrier 10 are shown by way of illustration and not limitation in groups of three, at 120° intervals around the circumference of carrier 10. Vertically adjacent groups of ports are rotationally offset 60°, so as to provide a better perforation pattern. Threads 18 and 18' are disposed at the top and bottom of carrier 10. Substantially tubular sleeve 20 encompasses or overlaps inner housing 12, covering gun ports 14, and extends therebeyond at both its upper end 22 and lower end 24. The inner diameter of sleeve 20 is only slightly larger than the outer diameter of housing 12, so that sleeve 20 will slide snugly over housing 12.

Bull plugs 30 and 30' having end caps 32 and 32', intermediate sealing portions 34 and 34' carrying O-rings 36 and 36' in grooves 38 and 38' and threaded inner protrusions 40 and 40', engage threads 18 and 18', respectively, in housing 12. End caps 32 and 32' engage the upper end 22 and lower end 24, respectively, of sleeve 20, thereby maintaining sleeve 20 in position over housing 12. O-rings 36 and 36' effect a fluid-tight seal between sleeve 20 and bull plugs 30 and 30', creating a pressure and fluid-tight chamber 42 inside housing 12. Housing 12 and sleeve 20 may both be preferably formed of 4130 alloy steel, and gun ports 14 may preferably be drilled or otherwise machined through the wall of housing 12. As noted previously, wires, firing mechanisims and various means of connecting carriers together in an end to end fashion may be employed in association with the basic configuration of bull plugs 30 and 30', but have been omitted for purposes of clarity. Furthermore, means other than threading may be employed to secure bull plugs to the ends of carrier 10, such as the use of set screws, bolts, or lug and slot engagement.

It should be understood and appreciated that sleeve 20 may be affixed to housing 12, rather than being merely held in place by bull plugs, connectors, or other mechanical means at each end of carrier 10, if so desired. For example, the exterior of housing 12 may be coated with a bonding agent, and sleeve 20 slipped over it. Alternatively, housing 12 may be coated with a soldering or brazing agent, sleeve 20 slipped thereover, and the assembly heated and subsequently cooled. A still further illustrative alternative is the use of welding, brazing, soldering or bonding at annular recesses 44 and 44' after sleeve 20 is placed over housing 12.

Figure 3:
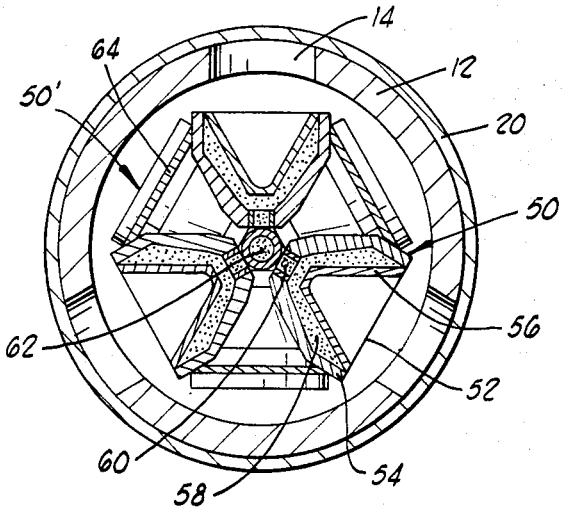
FIG. 3 is a section similar to FIG. 2, but enlarged and showing the disposition of shaped charges within the carrier of the present invention prior to firing.

FIG. 3 is a section taken across carrier 10 similar to that of FIG. 2, but depicting a cluster of three shaped charges 50 therein having their mouths 52 aligned with respective gun ports 14. A second cluster of shaped charges 50' is shown below charges 50, rotated 60° so as to be aligned with a lower group of gun ports 14 which is similarly offset (not shown). Charges 50 and 50' each comprise an outer casing 54 having a conical inner liner 56 therein, explosive 58 being contained therebetween. Each charge has a booster charge 60 at its rear, or inner end, which abuts detonating cord 62, which runs substantially through the centerline of carrier 10 and may be ignited by means well known in the art. Charges 50 and 50' are held in position by sheet metal brackets comprising a perforating gun, shown substantially in section at 64, which gun is in turn secured in place in carrier 10 by means not illustrated but well known to those of ordinary skill in the art. It will be readily observed and appreciated by one skilled in the art that the stand-off of the charges has been markedly increased over that possible with prior art carriers by the use of the inner housing/outer sleeve combination of the present invention. Moreover, it has been found that a carrier of the present invention comprising 4130 steel, of five inch O.D., having a sleeve wall thickness of one-eighth inch, a housing wall thickness of three-eighths of an inch, and a gun port diameter of three-quarters of an inch will easily withstand an external fluid pressure of 25,000 psig. In fact, subsequent to the aforesaid pressure test, the sleeve was easily removed from the inner housing, illustrating that no plastic deformation had taken place in the sleeve. These results indicate that a thinner outer sleeve is easily possible, with an attendant increase in stand-off or, alternatively, a less expensive material of lower strength might be used for the sleeve. In contrast, a steel tubular housing of five inch O.D., three-eighths inch wall thickness and having a $1\frac{1}{2}''$ diameter exterior recess machined therein to make a wall thickness of one-eighth inch in accordance with prior art practice and in similar fashion to that taught in the disclosure of U.S. Pat. No. 3,429,384 to Shore, was subjected to pressure in a similar manner to the carrier constructed in accordance with the present invention, and collapsed at 18,000 psig static pressure. While no "dimple" was placed in the recess, there is no showing in the patent that such a feature promotes compressive strength in the housing. In fact, it is believed that the metal working involved in "dimpling" as taught by Shore may create stresses which lead to failure at lower pressures (particularly in corrosive well fluids), and that misalignment of such a dimple within a recess may also contribute to subsequent failure under pressure.

Figure 4:
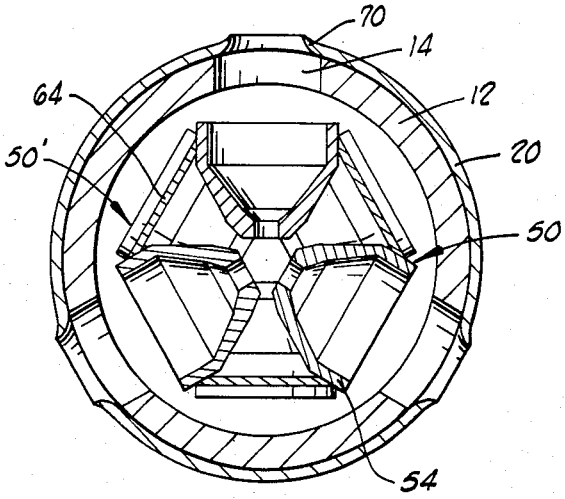
FIG. 4 is the section of FIG. 3, but during firing of the shaped charges and penetration of the outer sleeve.

FIG. 4 depicts carrier 10 after the shaped charges 50 and 50' have been initiated by detonating cord 62 and booster charges 60, in the process of firing prior to the destruction of charge casings 54 (which in actuality takes place substantially simultaneously with the creation of the explosive jet). It is readily apparent that the shaped charge jet has created a circular burr 70 at each gun port 14. However, the burrs 70 are formed solely of the material of the relatively thin outer sleeve 20, and are therefore relatively thin and protrude only slightly from the O.D. of sleeve 20, much of the sleeve material covering the gun ports 14 having been destroyed by the shaped charge jet. As a consequence, burrs 70 will not significantly impede the progress of carrier 10 as it is pulled upward, even in a small tubing string with minimal clearance around carrier 10.

Figure 5:
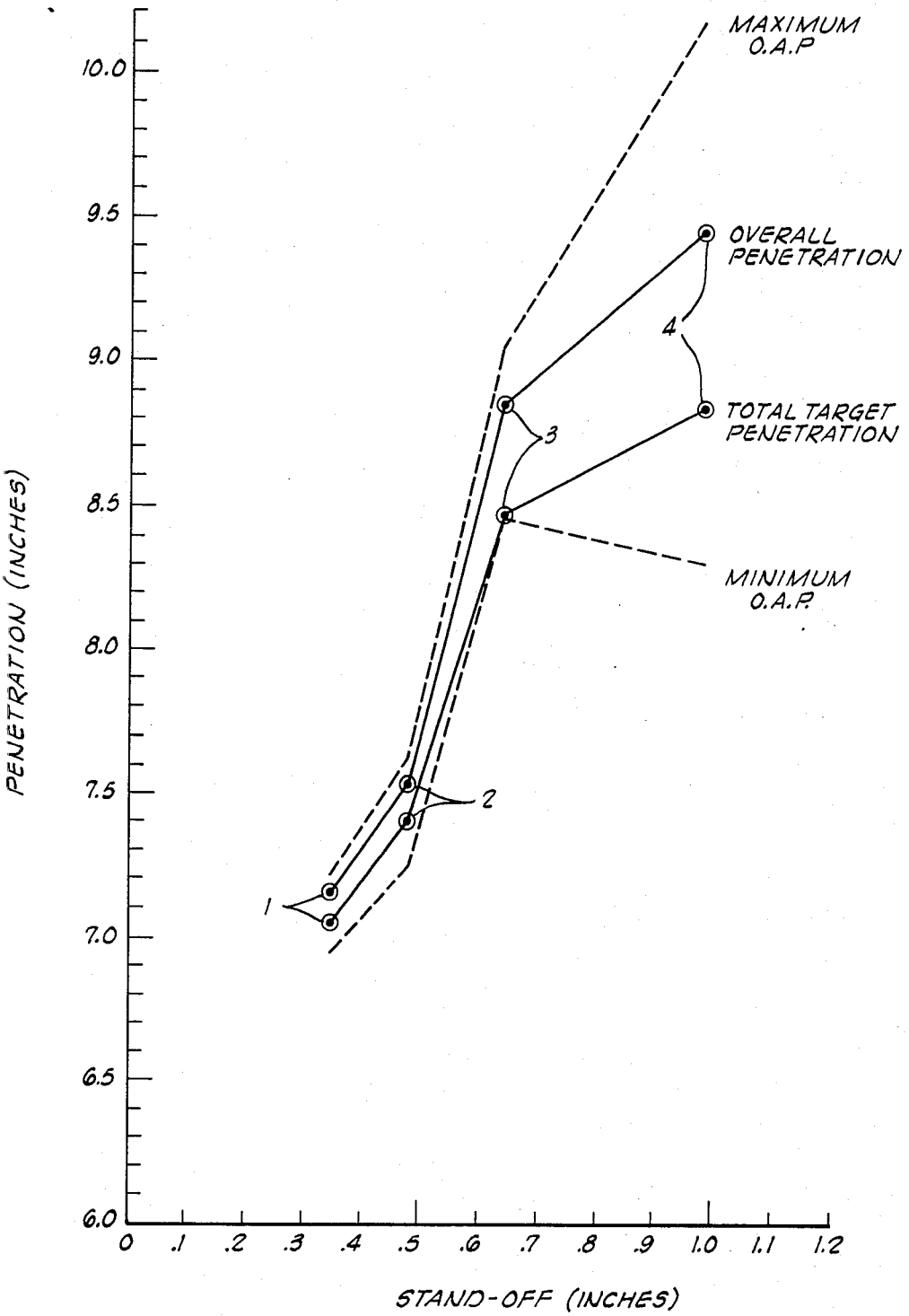
FIG. 5 is a chart illustrating penetration distance of a shaped charge as a function of stand-off.

FIG. 5 is a chart showing graphically the relationship between target penetration and overall penetration of a shaped charge jet as a function of the stand-off available for the shaped charge. Target penetration may be defined as the depth of the perforation a jet makes in a Berea target, measured from the front face of the target, a reference location generally used in shaped charge testing. Overall penetration may be defined as the distance from the front face of the target to the furthest point of penetration by the jet into the target, usually evidenced by a plug of debris or foreign material placed in the target by the jet. FIG. 5 was produced from target measurements made in the testing of a two inch SSB® shaped charge, manufactured by Jet Research Center, Inc., of Arlington, Tex. The broken lines indicate the range of maximum and minimum overall penetration achieved in testing, while the solid lines show the averages of the results for a given stand-off. The first set of points 1 indicate the average penetrations of a two inch SSB® shaped charge manufactured by Jet Research Center, Inc. of Arlington, Tex. in a two inch O.D. carrier having a gun port recess machined in its exterior surface, giving a stand-off of approximately 0.35 inches to the interior surface of the carrier. Points 2 correspond to the penetrations of the same charge in a two inch 0.D. carrier having a gun port recess machines in its interior surface, thereby increasing the stand-off to approximately 0.48 inches; the increase of approximately 0.35 inches in penetration. Points 3 correspond to the penetration of the same charge used with a two and one-eighth inch O.D. carrier having a gun port machined completely through the carrier wall and an exterior closure placed thereover, further increasing stand-off to approximately 0.63 inches; the increase of 0.28 inches in stand-off over that of points 1 resulted in a phenomenal 1.4 inches increase in target penetration, and 1.7 inches increase in overall penetration. The penetration results indicated by points 3 were substantially duplicated using a two inch O.D. carrier having a gun port machined through its wall and a domed closure on its exterior, to provide substantially the same stand-off for the charge. Points 4 were used as a reference to show the penetrations of a two inch SSB® charge fired from a one inch stand-off (outside of a carrier).

With respect to stand-off, it has been shown that there is a critical range of stand-off for shaped charges in which a small increase in stand-off results in a disproportionately and surprisingly large increase in penetration. Specifically, FIG. 5 indicates that for a two inch SSB® shaped charge, manufactured by Jet Research Center, Inc., an increase in stand-off of approximately 0.15 inches (between points 2 and points 3) results in a 1.05 inch increase in target penetration. Similar critical stand-off ranges have been observed with respect to substantially all shaped charge sizes and configurations. Therefore, it is readily apparent that in a carrier containing clusters of shaped charges, a major benefit is achieved by employing the carrier of the present invention, whereby (with respect to the five inch O.D. carrier of the foregoing example), a 0.375 inch increase in stand-off is achieved, more than enough to increase the stand-off of a clustered charge from the range around points 1 to that giving the results associated with points 3. While the desirability of increasing stand-off has been recognized in the prior art, ready means for achieving the desired stand-off increase, particularly while maintaining the structural integrity of a carrier and in conjunction with the use of clustered charges, have been lacking. The carrier of the present invention provides a relatively simple and inexpensive means of achieving the stand-off increase with none of the disadvantages associated with the attempts of the prior art.

DETAILED DESCRIPTION OF A SECOND PREFERRED EMBODIMENT

Figure 6:
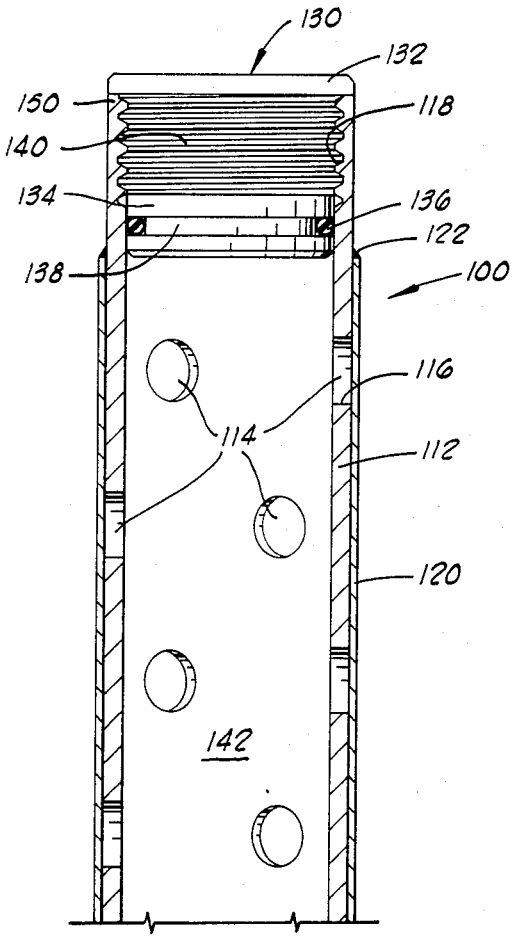
FIG. 6 is a full section vertical elevation illustrating a second preferred embodiment of the perforating gun carrier of the present invention.

Referring to FIG. 6, perforating gun carrier 100 is shown as comprising an inner housing 112 substantially identical to that of carrier 10, and pierced by gun ports 114 defined by laterally oriented walls 116 therethrough and having threads 118 therein. However, sleeve 120, instead of projecting beyond inner housing 112, is somewhat shorter but still overlaps gun ports 114. As a result, sleeve 120 may be readily welded at 122 to inner housing 112 to effect a pressure-tight seal, and to secure sleeve 120 in place. Modified bull plug 130 is employed with carrier 100, end cap 132 abutting end 150 of inner housing 112, and threaded intermediate portion 140 engaging threads 118. Sealing surface 134 is at the inner end of bull plug 130, and carries an O-ring 136 in annular groove 138. A similar bull plug or other appropriate closure is, of course, employed at the other end (not shown) of carrier 100. The seal configuration illustrated by bull plug 130 provides the advantage of a pressure seal against the inner wall of housing 112, which is of greater wall thickness than that of sleeve 120, or sleeve 20 of the embodiment of FIG. 1. Pressure and fluid-tight chamber 142 is created within carrier 100 by housing 112, sleeve 120 and bull plugs 130 or other appropriate end closures.

Of course, while welding has been mentioned as a possibility for securing sleeve 120 to housing 112, other means such as soldering, brazing or adhesive bonding are equally effective and appropriate.

The performance of shaped charges in carrier 100 is, of course, comparable to that of carrier 10 due to the similar increase in stand-off.

DETAILED DESCRIPTION OF A THIRD PREFERRED EMBODIMENT

Figure 7:
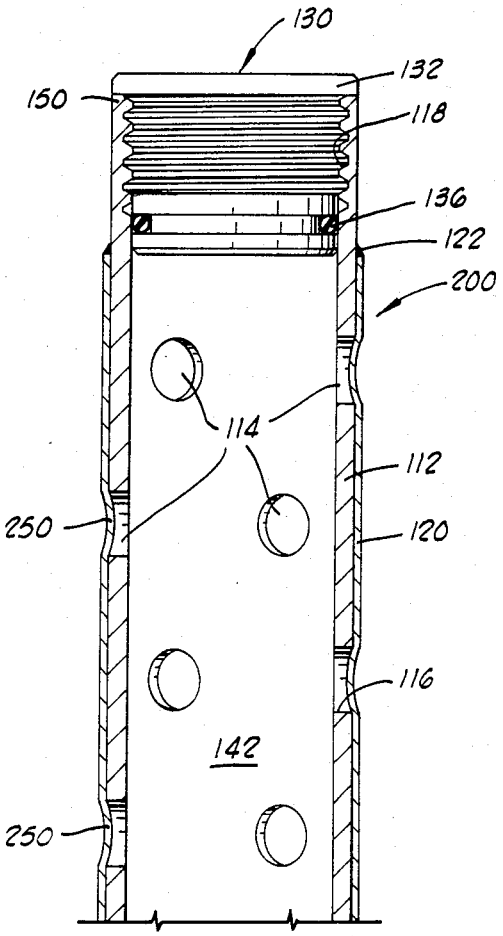
FIG. 7 is a full section vertical elevation illustrating a third preferred embodiment of the perforating gun carrier of the present invention.
Figure 8:
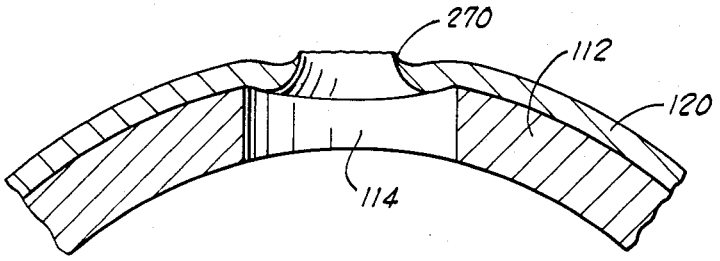
FIG. 8 is an enlarged sectional view of a gun port of the embodiment of FIG. 7 after firing of the shaped charge associated therewith.

Referring to FIGS. 7 and 8, the third preferred embodiment of the present invention comprises carrier 200, being identical in large part to carrier 100. Inner housing 112 with gun ports 114 is employed, as is outer sleeve 120, and bull plug 130, all the individual components being substantially the same as those shown in FIG. 6. However, unlike carrier 100, carrier 200 is assembled by shrink-fitting sleeve 120 over housing 112 to achieve an interference fit therebetween. For example and not by way of limitation, sleeve 120 and housing 112 may comprise 4130 alloy steel, housing 112 having a five inch O.D., and sleeve 120 having a five inch I.D. Both the housing and sleeve may be heat treated in a furnace to a temperature of approximately 1600° F. for a sufficient period of time to result in a Rockwell "C" hardness of 34 to 37. However, while housing 112 would be quenched in an oil bath at 900° F. and allowed to air cool, sleeve 120 would be quenched at 900° F. and placed over a previously cooled housing 112 at ambient temperature and permitted to cool on housing 112 to an interference fit. Sleeve 120 may then be welded, soldered or brazed to housing 112 at 122, as noted with respect to carrier 100 of FIG. 6, if necessary to effect a pressure-tight seal therebetween.

An additional feature of carrier 200 shown in FIGS. 7 and 8 is the inward dimpling at 250 of sleeve 120 over each gun port 114. This dimpling may be effected mechanically by employing appropriate dies, may result from the contraction of sleeve 120 as it cools over housing 112 during shrink-fitting, or may occur due to the application of a pressure differential between the inside and outside of carrier 200. Successful use of sleeve dimpling is, of course, dependent on the gun port diameter and the use of a sleeve material and thickness susceptible to deformation yet capable of holding external pressure after dimpling. Such inward dimpling does not significantly detract from the stand-off increase achieved by the sleeve/housing combination, yet, as illustrated in FIG. 8, results in burrs 270 after shaped charge firing, which burrs 270 are substantially recessed in the dimples and thereby are removed as a significant obstruction to the passage of carrier 270 through a tight tubing string. It should be understood that a dimpled sleeve may be employed with any embodiment of the carrier, and is not limited to use with a shrink-fit method of fabrication.

Yet another previously unmentioned advantage of the perforating gun carrier of the present invention is the possibility of multiple reusage of the inner housing. For example, after firing and retrieving a carrier of the present invention, the outer sleeve can be easily removed by machining and a new one placed on the inner housing. Tests have shown that firing charges in a five inch O.D. carrier as depicted in FIG. 1 results in a diametral expansion of the inner housing of only 0.012 inches, which may be easily machined off at the same time the outer sleeve is removed.

While the perforating gun carrier of the present invention has been disclosed with reference to several preferred embodiments, it will be understood by one of ordinary skill in the art that additions, deletions and modifications may be made to the preferred embodiments without departing from the spirit and scope of the claimed invention. For example, materials other than those disclosed may be employed in the sleeve and housing of the carrier, including other metals and nonmetallic materials of suitable physical characteristics and strength.

I claim:

1. A perforating gun carrier comprising:

in inner substantially tubular housing having a plurality of gun ports extending through the wall thereof; and an outer substantially tubular sleeve surrounding said inner housing in substantially circumferential contact therewith and covering said plurality of gun ports, said sleeve being imperforate proximate said housing gun ports.

2. The carrier of claim 1, wherein said sleeve is maintained in position over said housing by mechanical means at both ends of said carrier.

3. The carrier of claim 1, wherein said sleeve is maintained in position over said housing by a bonding means selected from the group of weld, solder, braze and adhesive.

4. The carrier of claim 1, wherein said sleeve and said housing are secured to one another by an interference fit.

5. The carrier of claim 1, wherein said sleeve protrudes concavely inward into each of said gun ports.

6. The carrier of claim 1, wherein said sleeve is bonded to said housing substantially throughout the area of overlap therebetween.

7. The carrier of claim 1, wherein said sleeve is bonded to said housing at the annular edge defining each end of the area of overlap therebetween.

8. The carrier of claim 1, wherein said sleeve possesses a lesser wall thickness than that of said housing.

9. The carrier of claim 1, further including plug means mechanically secured to each end of said carrier.

10. The carrier of claim 9, wherein said sleeve extends beyond each end of said carrier, and said plug carries seal means thereon adapted to create a pressure-tight seal between said plug means and said sleeve.

11. The carrier of claim 9, wherein said sleeve is shorter than said housing, and said plug means carries seal means thereon adapted to create a pressure-tight seal between said plug means and said inner housing.

12. A perforating gun carrier, comprising:

a substantially tubular alloy steel inner housing having a plurality of gun ports extending through the wall thereof;

a substantially tubular alloy steel outer sleeve of lesser wall thickness than said housing surrounding said housing in substantially circumferential contact therewith and secured thereto, said sleeve having a longitudinal extent sufficient to cover said gun ports and being imperforate in the vicinity thereof; and plug means at each end of said carrier, including mechanical engagement means adapted to engage said housing, and seal means adapted to create a pressure-tight chamber inside said carrier.

13. The carrier of claim 12, wherein said sleeve and said housing are bonded together by a bonding means selected from the group of weld, braze, solder, and adhesive.

14. The carrier of claim 12, wherein said housing and said sleeve are secured together by an interference fit.

15. A method of making a perforating gun carrier, comprising:

providing a substantially tubular metal inner housing;

forming a plurality of gun ports through the wall thereof;

sliding a substantially tubular metal outer sleeve over said inner housing; and securing said inner housing and outer sleeve together so that said housing and sleeve are in contact substantially throughout their mutual longitudinal extent.

16. The method of claim 15, wherein said step of securing includes heating said sleeve prior to sliding it over said housing, and cooling said sleeve on said housing to effect an interference fit therebetween.

17. The method of claim 15, wherein securing includes a step of bonding selected from the group of bonding methods comprising welding, brazing, soldering, and adhesive bonding.

18. The method of claim 15, wherein securing includes bonding said sleeve to said housing at the annular edge defining each extent of the area of overlap therebetween.

19. The method of claim 15, wherein securing includes mechanically positioning said housing within said sleeve.

* * * * *